US009490057B2

(12) United States Patent
Fu et al.

(10) Patent No.: US 9,490,057 B2
(45) Date of Patent: Nov. 8, 2016

(54) INTEGRATED MAGNETIC MODULE

(71) Applicant: DELTA ELECTRONICS, INC., Taoyuan Hsien (TW)

(72) Inventors: Ssu-Wei Fu, Taoyuan Hsien (TW); Yi-Hsin Leu, Taoyuan Hsien (TW); Chung-Ping Ku, Taoyuan Hsien (TW); Der-Min Liu, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 138 days.

(21) Appl. No.: 14/541,670

(22) Filed: Nov. 14, 2014

(65) Prior Publication Data

US 2016/0086711 A1 Mar. 24, 2016

(30) Foreign Application Priority Data

Sep. 18, 2014 (CN) ..... 2014 1 0477545

(51) Int. Cl.

| | |
|---|---|
| ***H01F 5/00*** | (2006.01) |
| ***H01F 27/28*** | (2006.01) |
| ***H01F 27/06*** | (2006.01) |
| ***H01F 27/24*** | (2006.01) |
| ***H01F 27/30*** | (2006.01) |

(52) U.S. Cl.

CPC ..... *H01F 27/06* (2013.01); *H01F 27/24* (2013.01); *H01F 27/2804* (2013.01); *H01F 27/303* (2013.01); *H01F 2027/2819* (2013.01)

(58) Field of Classification Search

CPC ..... H01F 5/00; H01F 27/28
USPC ..... 336/200, 232
See application file for complete search history.

(56) References Cited

U.S. PATENT DOCUMENTS

| | | | | |
|---|---|---|---|---|
| 8,498,124 | B1 * | 7/2013 | Folker | H05K 1/145 361/740 |
| 2013/0077276 | A1 * | 3/2013 | Kippley | H02M 7/003 361/784 |
| 2013/0323974 | A1 * | 12/2013 | Gutierrez | H01F 5/003 439/620.15 |
| 2014/0169042 | A1 * | 6/2014 | Eguchi | H02M 3/3353 363/21.06 |

* cited by examiner

*Primary Examiner* — Tsz Chan
(74) *Attorney, Agent, or Firm* — Kirton McConkie; Evan R. Witt

(57) ABSTRACT

An integrated magnetic module includes a first auxiliary circuit board, a second auxiliary circuit board, a first transformer, a second transformer and at least one inductor. The second auxiliary circuit board and the first auxiliary circuit board are arranged side by side. The first transformer is disposed on the first auxiliary circuit board. The second transformer is disposed on the second auxiliary circuit board. The at least one inductor is arranged between the first transformer and second transformer, and electrically connected with the first auxiliary circuit board and the second auxiliary circuit board.

10 Claims, 2 Drawing Sheets

INTEGRATED MAGNETIC MODULE

TECHNICAL FIELD

The present disclosure relates to an integrated magnetic module, and more particularly to an integrated magnetic module comprising two transformers and at least one inductor.

BACKGROUND OF THE DISCLOSURE

Magnetic elements such as transformers and inductors are widely used in many electronic devices to generate induced magnetic fluxes. For example, the transformer is a magnetic element that transfers electric energy from one circuit to another through coils in order to regulate the voltage to a desired range required for powering the electronic device. In addition, the inductor is usually electrically connected with the transformer for filtering signals.

FIG. 1 schematically illustrates a transformer and an inductor on a system board according to the prior art. As shown in FIG. 1, a first transformer 11, a second transformer 12 and an inductor 14 are disposed on a system board 10. In particular, the first transformer 11 and the second transformer 12 are disposed on a circuit board 13, and the circuit board 13 is inserted into the system board 10. In addition, the inductor 14 is directly mounted on the system board 10. Moreover, the first transformer 11, the second transformer 12 and the inductor 14 are electrically connected with each other through electrical traces (not shown). Consequently, the current outputted from the secondary side of the first transformer 11 and the current outputted from the secondary side of the second transformer 12 are transmitted to the system board 10 through the circuit board 13. After the currents are collected by the system board 10 and transmitted to the inductor 14, the output current is filtered by the inductor 14 and outputted to a load (not shown).

However, the layout structures of the above magnetic elements still have some drawbacks. Firstly, since the first transformer 11, the second transformer 12 and the inductor 14 are separately disposed on the system board 10, these magnetic elements occupy much layout space of the system board 10. The layout structures of the above magnetic elements are detrimental to the miniaturization and high power development of the electronic device. In other words, it is important to increase the space utilization and the component integration of the system board 10. Secondly, the layout structures of the above magnetic elements result in inconsistent current paths. That is, the current path from the secondary side of the second transformer 12 to the inductor 14 through the circuit board 13 and the system board 10 is longer than the current path from the secondary side of the first transformer 11 to the inductor 14 through the circuit board 13 and the system board 10. Due to the inconsistent current paths, the current outputted from the first transformer 11 and the current outputted from the second transformer 12 are unbalanced. Consequently, it is difficult to control the circuitry. Thirdly, since the current paths from the secondary sides of the first transformer 11 and the second transformer 12 to the inductor 14 through the circuit board 13 and the system board 10 are very long, the impedance value is very large. Under this circumstance, the power loss is increased. Moreover, since the currents from the first transformer 11 and the second transformer 12 are collected to the system board 10, the temperature of the system board 10 is too high.

Therefore, there is a need of providing an integrated magnetic module in order to overcome the above drawbacks.

SUMMARY OF THE DISCLOSURE

An object of the present disclosure provides an integrated magnetic module for achieving a current-balancing purpose.

Another object of the present disclosure provides an integrated magnetic module for reducing the impedance value, the power loss and the temperature of the system board.

In accordance with an aspect of the present disclosure, there is provided an integrated magnetic module. The integrated magnetic module includes a first auxiliary circuit board, a second auxiliary circuit board, a first transformer, a second transformer and at least one inductor. The second auxiliary circuit board and the first auxiliary circuit board are arranged side by side. The first transformer is disposed on the first auxiliary circuit board. The second transformer is disposed on the second auxiliary circuit board. The at least one inductor is arranged between the first transformer and the second transformer, and electrically connected with the first auxiliary circuit board and the second auxiliary circuit board.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
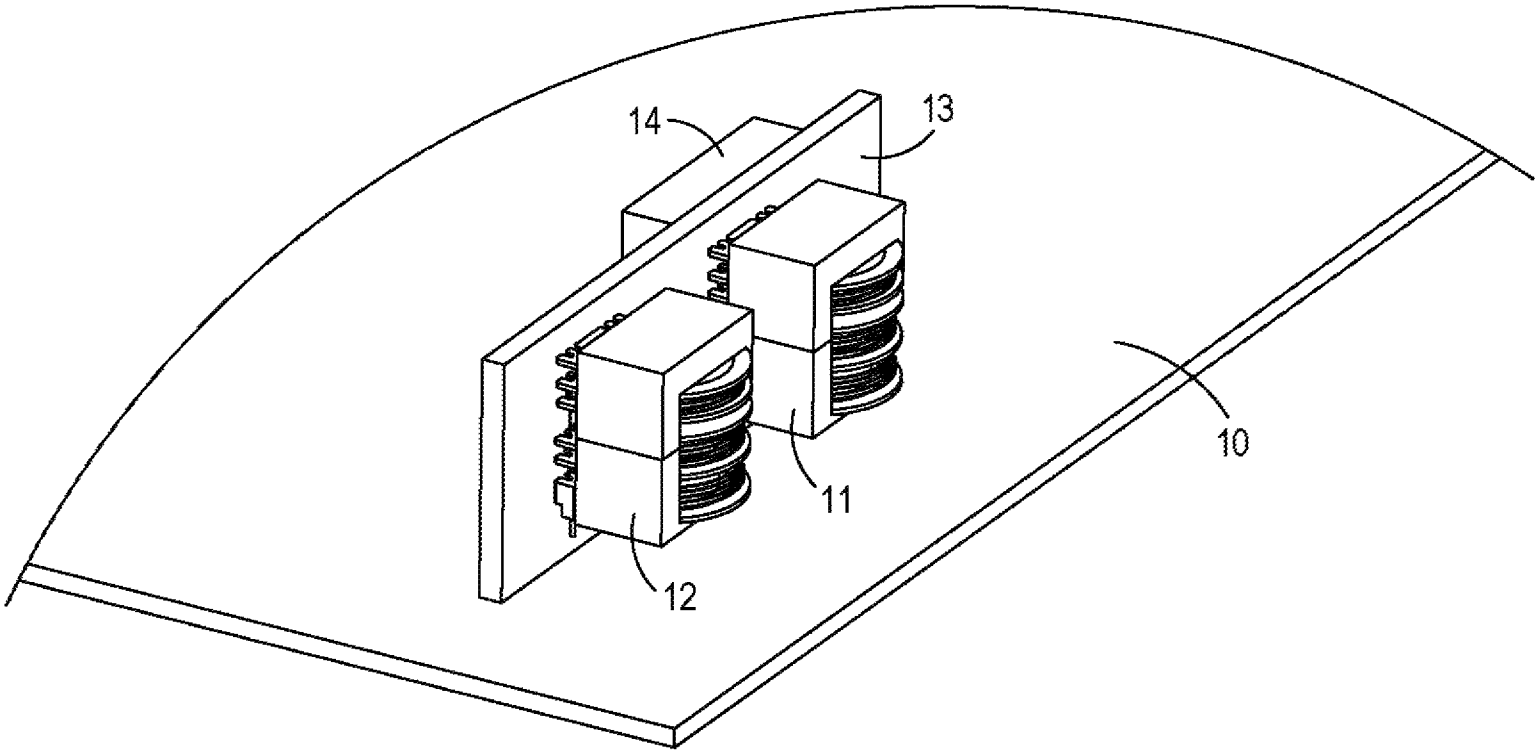
FIG. 1 PRIOR ART
FIG. 1 schematically illustrates a transformer and an inductor on a system board according to the prior art.
Figure 2:
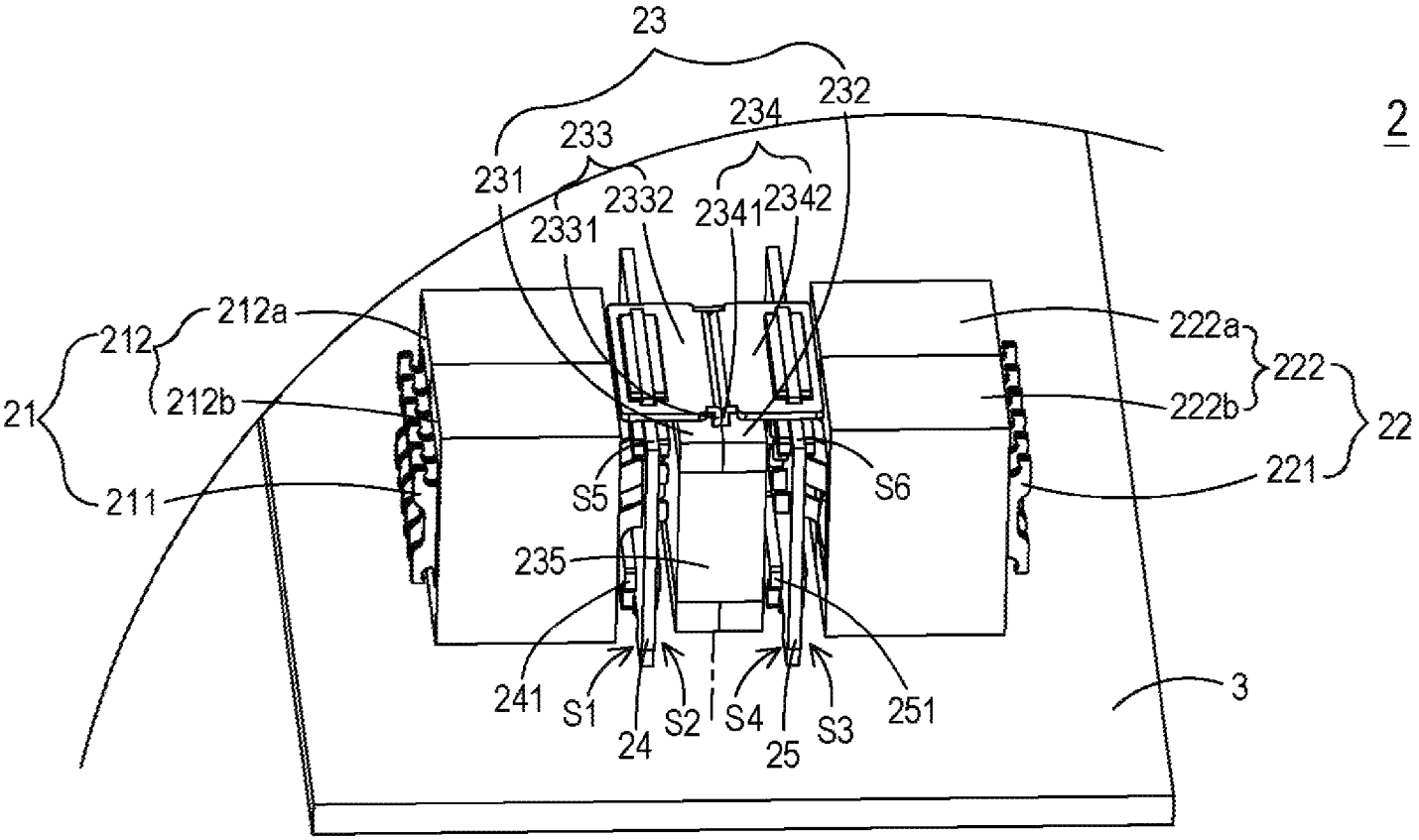
FIG. 2 is a schematic assembled view illustrating an integrated magnetic module according to an embodiment of the present disclosure.

FIG. 2 is a schematic assembled view illustrating an integrated magnetic module according to an embodiment of the present disclosure. As shown in FIG. 2, the integrated magnetic module 2 comprises a first auxiliary circuit board 24, a second auxiliary circuit board 25, a first transformer 21, a second transformer 22 and an inductor 23. The second auxiliary circuit board 25 and the first auxiliary circuit board 24 are arranged side by side. The first transformer 21 is inserted into corresponding insertion holes (not shown) of the first auxiliary circuit board 24. The second transformer 22 is inserted into corresponding insertion holes (not shown) of the second auxiliary circuit board 25. The inductor 23 is arranged between the first transformer 21 and second transformer 22. In addition, the inductor 23 is electrically connected with the first auxiliary circuit board 24 and the second auxiliary circuit board 25. The detailed structures of the integrated magnetic module 2 will be illustrated as follows.

As shown in FIG. 2, the first auxiliary circuit board 24 and the second auxiliary circuit board 25 are arranged side by side and in parallel with each other. The first auxiliary circuit board 24 has a first surface S1 and a second surface S2, which are opposed to each other. The second auxiliary circuit board 25 has a third surface S3 and a fourth surface S4, which are opposed to each other. The second surface S2 of the first auxiliary circuit board 24 and the fourth surface S4 of the second auxiliary circuit board 25 face each other.

In this embodiment, the first transformer 21 comprises a first winding assembly 211 and a first magnetic core assembly 212. The first winding assembly 211 comprises plural ring-shaped conductive metal sheets. The hollow portions of these ring-shaped conductive metal sheets are collaboratively defined as a channel (not shown). In another embodiment, the first winding assembly 211 comprises a bobbin and a winding coil wound around the bobbin. The first magnetic core assembly 212 comprises two magnetic cores 212*a* and 212*b*. In this embodiment, the two magnetic cores 212*a* and 212*b* are E cores. That is, the first magnetic core assembly 212 is an EE-type magnetic core assembly. The E core comprises a middle leg (not shown) and two lateral legs (not shown). The middle legs of the two magnetic cores 212*a* and 212*b* are embedded into the channel of the first winding assembly 211 from two opposed ends of the first winding assembly 211, respectively. Consequently, the first winding assembly 211 and the first magnetic core assembly 212 interact with each other to achieve the purpose of voltage transformation. Moreover, in this embodiment, the first transformer 21 is disposed on the first surface S1 of the first auxiliary circuit board 24, but is not limited thereto.

In this embodiment, the second transformer 22 comprises a second winding assembly 221 and a second magnetic core assembly 222. The second magnetic core assembly 222 comprises two magnetic cores 222*a* and 222*b*. The detailed structures and the assembling processes of the second transformer 22 are similar to those of the first transformer 21, and are not redundantly described herein. Moreover, in this embodiment, the second transformer 22 is disposed on the third surface S3 of the second auxiliary circuit board 25, but is not limited thereto.

The integrated magnetic module 2 comprises at least one inductor 23. As shown in FIG. 2, the inductor 23 is arranged between the second surface S2 of the first auxiliary circuit board 24 and the fourth surface S4 of the second auxiliary circuit board 25. Moreover, the inductor 23 is electrically connected with the first auxiliary circuit board 24 and the second auxiliary circuit board 25. In this embodiment, the inductor 23 comprises a first magnetic core 231, a second magnetic core 232, a first conductive plate 233 and a second conductive plate 234. The first conductive plate 233 and the second conductive plate 234 are collaboratively defined as a conductive module of the inductor 23. In another embodiment, a coil is formed as the conductive module of the inductor 23. In this embodiment, the first conductive plate 233 and the second conductive plate 234 are clamped between the first magnetic core 231 and second magnetic core 232. The first conductive plate 233 comprises a first main body 2331 and a first extension part 2332. The first main body 2331 is arranged between the first magnetic core 231 and second magnetic core 232. The first extension part 2332 is perpendicular to and extended externally from the first main body 2331. In addition, the first extension part 2332 is connected with a fifth surface S5 of the first auxiliary circuit board 24. The fifth surface S5 is a lateral side of the first auxiliary circuit board 24, and adjacent to the first surface S1 and the second surface S2. Similarly, the second conductive plate 234 comprises a second main body 2341 and a second extension part 2342. The second main body 2341 is arranged between the first magnetic core 231 and second magnetic core 232. The second extension part 2342 is perpendicular to and extended externally from the second main body 2341. In addition, the second extension part 2342 is connected with a sixth surface S6 of the second auxiliary circuit board 25. The sixth surface S6 is a lateral side of the second auxiliary circuit board 25, and adjacent to the third surface S3 and the fourth surface S4. In other words, the inductor 23 is electrically connected with the first auxiliary circuit board 24 and the second auxiliary circuit board 25 through the first extension part 2332 of the first conductive plate 233 and the second extension part 2342 of the second conductive plate 234. Moreover, through the electrical traces (not shown) of the first auxiliary circuit board 24 and the second auxiliary circuit board 25, the inductor 23 is electrically connected with the first transformer 21 and the second transformer 22.

A process of assembling the integrated magnetic module 2 will be illustrated in more details as follows. Firstly, the first auxiliary circuit board 24 and the second auxiliary circuit board 25 are arranged side by side and in parallel with each other, wherein the second surface S2 of the first auxiliary circuit board 24 and the fourth surface S4 of the second auxiliary circuit board 25 face each other. Then, the first transformer 21 is disposed on the first surface S1 of the first auxiliary circuit board 24, and the second transformer 22 is disposed on the third surface S3 of the second auxiliary circuit board 25. Then, the first transformer 21 and the second transformer 22 are fixed on the first auxiliary circuit board 24 and the second auxiliary circuit board 25 via soldering materials. Consequently, the first transformer 21 and the second transformer 22 are electrically connected with the first auxiliary circuit board 24 and the second auxiliary circuit board 25, respectively. Then, the inductor 23 is assembled. In particular, the first main body 2331 of the first conductive plate 233 and the second main body 2341 of the second conductive plate 234 are clamped between the first magnetic core 231 and the second magnetic core 232, and the first extension part 2332 and the second extension part 2342 are extended externally from the first main body 2331 of the first conductive plate 233 and the second main body 2341 of the second conductive plate 234, respectively. Then, an insulation tape 235 is wound around a part of the first magnetic core 231 and a part of the second magnetic core 232. Consequently, the first conductive plate 233 and the second conductive plate 234 are fixed between the first magnetic core 231 and second magnetic core 232 and the inductor 23 is isolated from the adjacent components. Meanwhile, the inductor 23 is completely assembled. Then, the inductor 23 is arranged between the second surface S2 of the first auxiliary circuit board 24 and the fourth surface S4 of the second auxiliary circuit board 25. In addition, the first extension part 2332 of the first conductive plate 233 is soldered on the fifth surface S5 of the first auxiliary circuit board 24, and the second extension part 2342 of the second conductive plate 234 is soldered on the sixth surface S6 of the second auxiliary circuit board 25. Consequently, the inductor 23 is electrically connected with the first auxiliary circuit board 24 and the second auxiliary circuit board 25 through the first extension part 2332 of the first conductive plate 233 and the second extension part 2342 of the second conductive plate 234. Moreover, the inductor 23 is electrically connected with the first transformer 21 and the second transformer 22 through the electrical traces (not shown) of the first auxiliary circuit board 24 and the second auxiliary circuit board 25. Meanwhile, the process of assembling the integrated magnetic module 2 is completed.

Moreover, at least one first switch element 241 is disposed on the first surface S1 or the second surface S2 of the first auxiliary circuit board 24, and at least one second switch element 251 is disposed on the third surface S3 or the fourth surface S4 of the second auxiliary circuit board 25. In an embodiment, the first switch element 241 and the second switch element 251 are synchronous rectification switches such as diodes or metal-oxide-semiconductor field-effect transistors (MOSFET). By the first switch element 241 and the second switch element 251, an AC power from the first transformer 21 and the second transformer 22 is rectified into a DC power.

From the above discussions, the integrated magnetic module 2 comprises the first transformer 21, the second transformer 22, the inductor 23, the first auxiliary circuit board 24 and the second auxiliary circuit board 25. Moreover, at least one first switch element 241 is disposed on the first auxiliary circuit board 24, and at least one second switch element 251 is disposed on the second auxiliary circuit board 25. Consequently, the integrated magnetic module 2 has the functions of transforming, rectifying and filtering voltages. In the integrated magnetic module 2, the inductor 23 is arranged between the first auxiliary circuit board 24 and the second auxiliary circuit board 25. The first transformer 21 and the second transformer 22 are located at outer sides of the first auxiliary circuit board 24 and the second auxiliary circuit board 25. In other words, the first transformer 21 and the second transformer 22, and the first switch element 241 and the second switch element 251 are symmetrical relative to the inductor 23. Moreover, the integrated magnetic module 2 is disposed on a system board 3 and electrically connected with the system board 3.

Moreover, the first transformer 21, the first switch element 241 and the inductor 23 are arranged along a first current path. A first current flows through the first switch element 241, the first transformer 21 and the inductor 23 sequentially along the first current path. That is, the first current flows from the first switch element 241 to the first transformer 21, and then after the first current flows from the first transformer 21 to the inductor 23, the first current is filtered by the inductor 23. Similarly, the second transformer 22, the second switch element 251 and the inductor 23 are arranged along a second current path. A second current flows through the second switch element 251, the second transformer 22 and the inductor 23 sequentially along the second current path. That is, the second current flows from the second switch element 251 to the second transformer 22, and then after the second current flows from the second transformer 22 to the inductor 23, the second current is filtered by the inductor 23. After the first current flows through the first current path and the second current flows through the second current path, the first current and the second current are collected and outputted to a load (not shown). Since the electronic components of the integrated magnetic module 2 are symmetrical with respect to each other, the length of the first current path and the length of the second current path are substantially equal. Consequently, the purpose of current-balancing is achieved. In an embodiment, the first current flowing through the first current path and the second current flowing through the second current path are higher than or equal to 80 A.

Due to the structures and the assembling processes of the integrated magnetic module 2, the currents outputted from the first transformer 21 and the second transformer 22 can be transmitted to the inductor 23. But as previously mentioned in the prior art, the currents are filtered by the inductor 14 after the currents from the first transformer 11 and the second transformer 12 are collected to the system board 10. In comparison with the conventional layout structures, the length of the current path is shortened and the power loss is reduced. Moreover, since the currents of the integrated magnetic module 2 do not flow through the system board 3, the temperature of the system board 3 is not too high. Moreover, since the first transformer 21, the second transformer 22, the inductor 23 and the synchronous rectification switches are integrated into a module, the assembling process is simplified and the electronic components are effectively integrated. When the integrated magnetic module 2 is disposed on the system board 3, the space utilization and the component integration of the system board 3 are enhanced. In addition, the layout structures of the integrated magnetic module 2 are advantageous for miniaturization and high power development of the electronic device.

From the above descriptions, the present disclosure provides an integrated magnetic module. In the integrated magnetic module, a first transformer, a second transformer, an inductor and two synchronous rectification switches are integrated into a module. Consequently, the assembling process is simplified, the electronic components are effectively integrated and the space utilization of the system board is enhanced. Moreover, since the electronic components of the integrated magnetic module are symmetrical with respect to each other, the length of the first current path and the length of the second current path are substantially equal. Consequently, the purpose of current-balancing is achieved. Moreover, the currents are directly transmitted from the transformers to the inductor without the need of being transferred through the system board. Consequently, the impedance value, the power loss and the temperature of the system board are reduced.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An integrated magnetic module, comprising:

a first auxiliary circuit board, wherein the first auxiliary circuit board has a first surface and a second surface opposed to the first surface;

a second auxiliary circuit board, wherein the second auxiliary circuit board has a third surface and a fourth surface opposed to the third surface, the second auxiliary circuit board and the first auxiliary circuit board are arranged side by side, and the second surface of the first auxiliary circuit board and the fourth surface of the second auxiliary circuit board face each other;

a first transformer disposed on the first surface of the first auxiliary circuit board;

a second transformer disposed on the third surface of the second auxiliary circuit board; and at least one inductor arranged between the first transformer and second transformer and electrically connected with the second surface of the first auxiliary circuit board and the fourth surface of the second auxiliary circuit board.

2. The integrated magnetic module according to claim 1, wherein the inductor is arranged between the first auxiliary circuit board and the second auxiliary circuit board.

3. The integrated magnetic module according to claim 1, wherein the inductor comprises a first magnetic core, a second magnetic core, a first conductive plate and a second conductive plate, wherein the first conductive plate comprises a first main body and a first extension part, and the second conductive plate comprises a second main body and a second extension part, wherein the first main body and the second main body are arranged between the first magnetic core and the second magnetic core, the first extension part is perpendicular to and extended externally from the first main body, and the second extension part is perpendicular to and extended externally from the second main body.

4. The integrated magnetic module according to claim 3, wherein the first extension part of the first conductive plate are electrically connected with electrical traces of the first auxiliary circuit board, and the second extension part of the second conductive plate are electrically connected with electrical traces of the second auxiliary circuit board, so that the inductor is electrically connected with the first transformer and the second transformer.

5. The integrated magnetic module according to claim 1, wherein at least one first switch element is disposed on the first auxiliary circuit board, and at least one second switch element is disposed on the second auxiliary circuit board.

6. The integrated magnetic module according to claim 5, wherein the first switch element and the second switch element are synchronous rectification switches.

7. The integrated magnetic module according to claim 5, wherein the first transformer, the first switch element and the inductor are arranged along a first current path, and a first current flows through the first switch element, the first transformer and the inductor sequentially along the first current path, wherein the second transformer, the second switch element and the inductor are arranged along a second current path, and a second current flows through the second switch element, the second transformer and the inductor sequentially along the second current path.

8. The integrated magnetic module according to claim 7, wherein the first transformer and the second transformer are symmetrical relative to the inductor, so that a length of the first current path and a length of the second current path are equal.

9. The integrated magnetic module according to claim 7, wherein the first current flowing through the first current path and the second current flowing through the second current path are higher than or equal to 80 A.

10. The integrated magnetic module according to claim 1, wherein the integrated magnetic module is disposed on a system board.

* * * * *